United States Patent [19]

Quam et al.

[11] Patent Number: 4,679,549

[45] Date of Patent: Jul. 14, 1987

[54] INTEGRAL FOOT MASSAGE AND SUPPORT APPARATUS

[76] Inventors: William M. Quam; Dorothy M. Quam, both of 241 Conejo Rd., Santa Barbara, Calif. 93103

[21] Appl. No.: 656,265

[22] Filed: Nov. 21, 1984

Related U.S. Application Data

[60] Division of Ser. No. 516,700, Jul. 22, 1983, which is a continuation-in-part of Ser. No. 445,196, Nov. 29, 1982.

[51] Int. Cl.[4] ..... A61H 15/00; A63B 23/04

[52] U.S. Cl. ..... 128/57; 272/96; 272/146

[58] Field of Search ..... 272/96, 146, 105; 128/56, 57, 58, 25 B, 33

[56] References Cited

U.S. PATENT DOCUMENTS

| | | | |
|---|---|---|---|
| 1,569,467 | 1/1926 | Edwards | 272/96 |
| 4,291,873 | 9/1981 | Lee et al. | 272/146 |
| 4,319,749 | 3/1982 | Agyagos | 272/146 |
| 4,347,838 | 9/1982 | McCauley | 272/96 |
| 4,422,635 | 12/1983 | Herod et al. | 272/96 |

FOREIGN PATENT DOCUMENTS

| | | | |
|---|---|---|---|
| 912602 | 10/1972 | Canada | 272/96 |
| 2537461 | 3/1977 | Fed. Rep. of Germany | 272/96 |

*Primary Examiner*—Richard J. Apley
*Assistant Examiner*—S. R. Crow
*Attorney, Agent, or Firm*—Daniel J. Meaney, Jr.

[57] ABSTRACT

A combined foot massage and support having a base support including a base plate having a substantially planar surface and a second opposite surface, a pair of substantially planar side support members each of which terminate in a first support end and a second support end wherein the first support end of each of the side support members includes a member defining a substantially planar support surface and the second support end of each of the side support members are located opposite the first support end and includes a ramp support surface having a slope which approximates the ergonomic design angle for a human user in a sitting position, a plurality of massage assemblies mounted axially on and rotatable about the center support wherein the center support members are mounted in an arcuate, spaced parallel alignment the spaced parallel planar side support members above the base support and a pivotal base plate which is adapted to be engaged and pivoted by at least one foot of a user is shown.

6 Claims, 18 Drawing Figures

INTEGRAL FOOT MASSAGE AND SUPPORT APPARATUS

RELATED APPLICATIONS

This application is a divisional of Ser. No. 06/516700 filed July 22, 1983 which is a continuation-in-part of U.S. patent application Ser. No. 06/445,196 filed on Nov. 29, 1982.

BACKGROUND OF THE INVENTION

1. Field of the Invention

This invention relates to a combined foot massage and support and more particularly to an integral foot massage and foot support apparatus having a foot massage treating surface, a foot supporting surface and, if desired, a rotatable disc actuatable by the foot of a user, which are adapted to interact with the foot of a user at approximately the ergonomic design angle which is adapted to reduce fatigue, stress and discomfort of the thigh, lower leg and foot of a human user in a sitting position.

2. Description of the Prior Art

Foot massage apparatus and the like are known in the prior art. Typical of such devices are those disclosed in U.S. Pat. Nos. Des. 253,967; Des. 255,835 and Des. 257,883. Massage devices adapted for massaging selected portions of the body of a user are likewise known in the art. Typical of such devices is that disclosed in U.S. Pat. No. Des. 263,623.

A Body Toner massage apparatus comprising a "U" shaped member having a rod with a plurality of axially aligned, rotatable disc members mounted thereon extending between the ends of the "U" shaped member is distributed by Graham Bell Industries of Brea, Calif. In use, the user supports the massage apparatus by the curved portion of the "U" shaped member, applies the rotatable discs to the portion of the body to be massaged and moves the massage apparatus in either a linear or curvilinear motion to produce the massaging treatment. Another massage apparatus distributed by the above firm under the mark Captain Carrot Caresser comprises a device in the form of an elongated shaft having disc shaped, rotatable elements therearound and the massaging treatment is produced by rolling the same, in a motion similiar to rolling pie dough with a rolling pin, over the portion of the body of a user to be massaged.

It is also known in the art to utilize footstools, footrests and the like by a worker or other person who sits for an extended period of time. The purpose for using such devices is to elevate the feet of a user to relieve stress from the lower back and legs. The foot fatigue footrest is typically higher in the front relative to the back in order to place the feet at an angle relative to the supporting surface, such as for example, an office floor. Such footrests are offered for sale for use by computer terminal operators by Devoke Data Products, 3780 Fabian Way, Palo Alto, Calif. 94303.

Another known footrest having a wedge shape for receiving and supporting the feet of a user in a sitting position, which is characterized as as "New Ergonomic Footrest" is offered for sale by Moore Business Products of Wheeling, Ill. The wedgeshaped footrest includes a foot operated knob for varying the angle of the top, foot receiving surface relative to a fixed base in engagement with the floor.

It is also known in the art to utilize adjustable or rotatable platforms for supporting a keyboard of a computer terminal at a proper or adjustable ergonomic angle for the user. One such device is offered for sale by Biotech Systems, 3158 Production Drive, Fairfield, Ohio 45014.

It is also recognized in the art to design office furniture, such as chairs for example, to have a specially designed seat and back support members which conform with the human body in both a sitting position and when the user shifts body position when in a substantially sitting position. One such chair is distributed and offered for sale under the trademark BIO CHAIR by American Seating, 901 Broadway, N.W., Grand Rapids, MI 49504.

The concept of ergonomics, that is the study of how the human body interacts with a mechanical environment, is being applied to the design of office furniture, computer terminals and equipment generally operated by human beings in a sitting position. The application of ergonomic principles to designs of such devices has as its intended purpose the reduction of fatigue, stress and discomfort in daily work situations.

Several texts are available which describe and teach the use of ergonomics in order to increase productivity of humans. One such text is in a book entitled THE BIOMEDICAL BASIS OF ERGONOMICS (1978), E. R. Tichauer, published by Wiley-Interscience Publication which sets forth at page 71 thereof the advantages of properly designed chairs in a production environment.

Also, numerous medical reports and articles are well known in the art which teach the advantages of elevating the feet of a user in a sitting position to relieve fatigue in the legs and thighs.

However, the art is devoid of any suggestions, teachings or disclosures which recognize the advantages associated with an apparatus having both a foot massaging surface and a foot receiving and support surface and having the same positioned at a slope which approximates the ergonomic design angle which is adapted to reduce fatigue, stress and discomfort of the thigh, lower leg and foot of a human user in a sitting position.

SUMMARY OF THE INVENTION

The present invention relates to a new, novel and unique combined foot massage and support. In the preferred embodiment, the combined foot massage and support includes a base support which has a base plate having a substantially planar surface and a second opposite surface and a circular shaped opening located centrally therein. The combined foot massage and support includes a pair of substantially planar side support members each of which terminate in a first support end and a second support end. The first support end of each of the side support members include means defining a substantially planar support surface and the second support end of each of the side support members are located opposite the first support end and includes means defining a ramp support surface having a a slope which approximates the ergonomic design angle which is adapted to reduce fatigue, stress and discomfort of the thigh, lower leg and foot of a human user in a sitting position. The substantially planar side support members are operatively coupled to and extending in the same substantially normal direction from the base support and base plate and in a spaced parallel relationship to each other with the substantially planar support surface of the first support end of each of said side support members positioned adjacent the base support and with the ramp support surface of the second support end of each of said side support members positioned with the ramp support surface extending in the same direction. The support further includes a plurality of massage assemblies each of which include an axially extending center support member and a plurality of annular shaped massage elements mounted axially on and rotatable about said center support members. The center support members are mounted in an arcuate, spaced parallel alignment between the spaced parallel planar side support members above the base support and above the opposite side of the base plate. The plurality of massage elements are mounted on the center support members and have a radius which extends therefrom to below the ramp support surfaces to form a convex shaped, angularly disposed treating surface which extends substantially between the substantially parallel side support members. The support member has a means including a rotatable disc positioned in the circular opening in the base plate which is adapted to be engaged and rotated by at least one foot of a user. The foot massage and support are adapted to have a massage position wherein the base support, the substantially planar surface of the base plate and the substantially planar surface of the side support members are positioned on a supporting surface placing the convex shaped, angularly disposed treating surface in a massage position which is adapted to receive the feet of a user. The feet of a user may be massaged by movement of the feet relative to the rotatably mounted massage elements and a support position wherein the ramp support surfaces of the second support end of each side support members are positioned on a supporting surface placing the base support including the substantially planar surface of the base plate at an angle to receive and support the feet of a user.

The present invention overcomes certain of the deficiencies of the known prior art footrests. None of the known prior art devices suggest or disclose the positioning of foot massaging devices at an angle which approximates the ergonomic design angle which is adapted to reduce fatigue, stress and discomfort of the thigh, lower leg and foot of a human user in a sitting position.

One advantage of the present invention is that a combined foot massage and support device is disclosed wherein both the foot treating surface and the foot receiving and supporting surface are at the ergonomic design angle.

Another advantage of the present invention is that the foot treating surface can be formed of a plurality of massage assemblies each of which include an axially extending center support member and a plurality of annular shaped massage elements mounted axially on and rotatably about said center support members which are mounted in an arcuate, spaced parallel alignment between spaced parallel planar side support members to form an arch type surface which is adapted to conform with the arch of the foot of a user.

A yet another advantage of the present invention is that the foot receiving and supporting surface and the foot treating surface can be easily reversed by merely reversing the integral foot massage and foot support apparatus.

A still yet further advantage of the present invention is the the foot receiving and supporting surface can be fixed relative to the foot treating surface at the desired ergonomic design angle.

A yet still further advantage of the present invention is that the foot receiving and support surface can be covered with a rubberized matt or resilient covering, having a plurality of substantially parallel protruding members which can be used to cushion or resiliently support the feet. Also, the resilient covering stimulates circulation in the foot as a result of relative movement therebetween.

A still yet further advantage of the present invention is that the base support can be integral with the apparatus housing and a base plate can be pivotally mounted to the base support such that the angle of the base plate can be varied relative to the base support by an elongated rod and cam assembly.

Another advantage of the present invention is that the selected ergonomic design angle further helps circulation of the body in the unstressed area and further reduces pressure, compression and strain on the back.

Another advantage of the present invention is that a combined foot massage and support device can be fabricated in a width to accomodate one foot of a user.

Another advantage of the present invention is that the base plate can be fabricated with a rotatable disc located centrally therein to enable a user to place a foot thereon and obtain exercise by rotating the disc with the foot.

A still yet further advantage of the present invention is that the base plate can be centrally pivotly mounted on the side walls such that a user can exercise a foot by a pitching axis about the pivotal axis of the base plate.

A stii yet further advantage of the present invention is that the pivotaly base plate can be split to as to permit independent pitching movement of each half of the base plate with the feet of a user.

A still further advantage of the present invention is that the base plate, with or without the rotatable disc, can be slideably mounted to the side supports to enable a user to slideably extend the base plate along a plane and to still pivot or pitch the base plate about the pivotal axis.

BRIEF DESCRIPTION OF THE DRAWING

The foregoing and other advantages and features of this invention will become apparent from the following description of the preferred embodiment, when considered together with the illustrations and accompanying drawing which includes the following Figures.

DESCRIPTION OF THE PREFERRED EMBODIMENT

Figure 1:
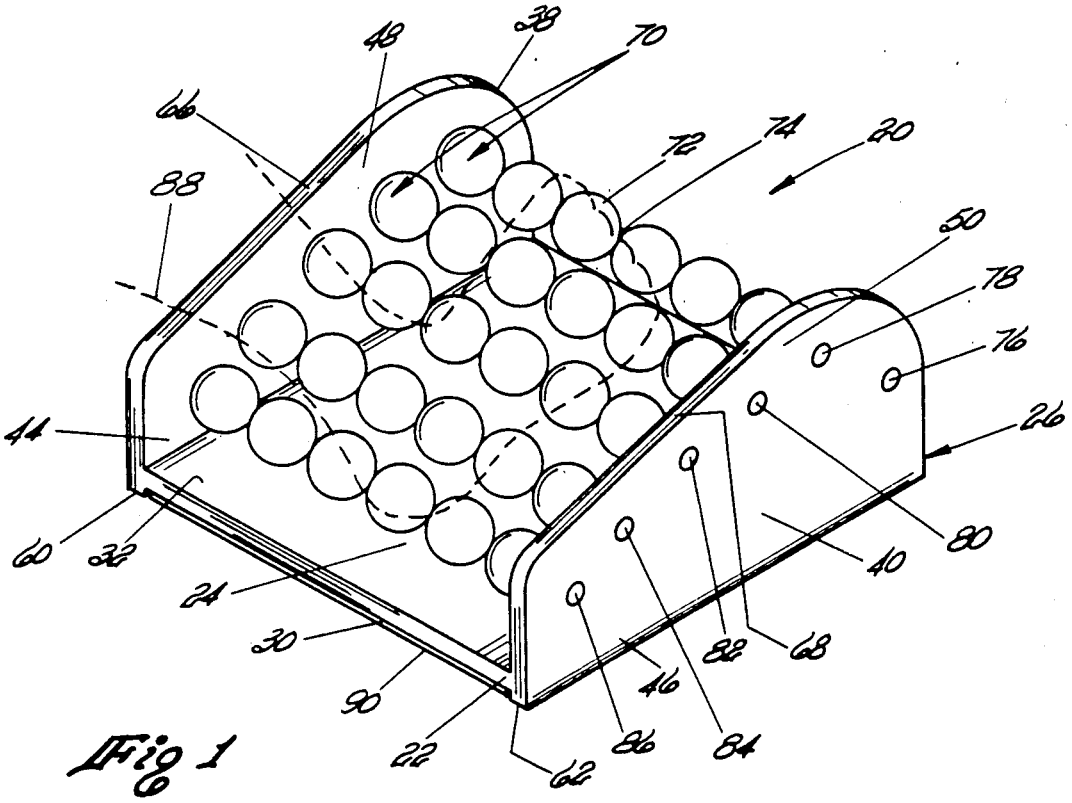
FIG. 1 is a top perspective view of a combined foot massage and support having a plurality of massaging assemblies using the teachings of the present invention.
Figure 2:
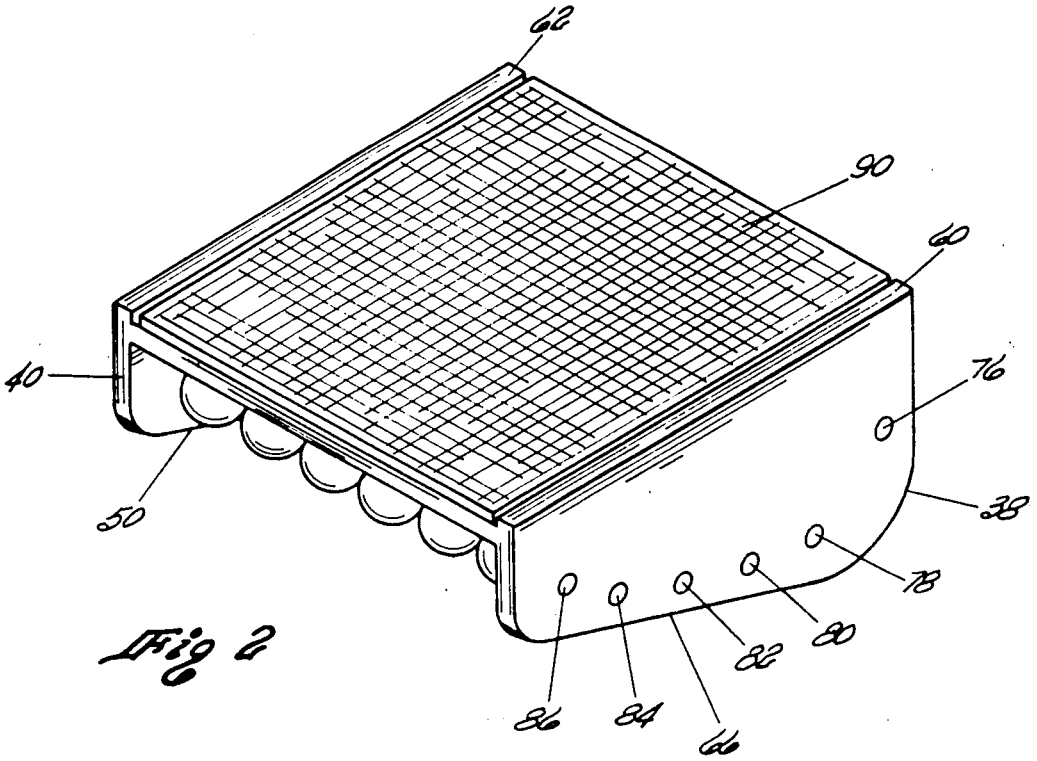
FIG. 2 is a bottom perspective view of the foot massage and support of FIG. 1.

FIGS. 1 and 2 illustrate a combined foot massage and support which is shown generally by arrow 20. The combined foot massage and support comprises a base support 22 which includes a base plate 24. The base plate 24 is integral with the base support 22 which forms part of a housing means shown generally as 26. The base plate 24 has a substantially planar surface 30 and a second opposite surface 32. The housing means includes means for defining a pair of substantially planar side support members 38 and 40, each of which terminate in a first support end 44 and 46, respectively, and a second end 48 and 50, respectively. The first support ends 44 and 46 of side support members 38 and 40, respectively, including means defining a substantially planar support surface 60 and 62, respectively. The second support ends 48 and 50 of side support members 38 and 40, respectively, are located opposite the first support ends 44 and 46, respectively. The second support ends 48 and 50 include means defining a ramp support surface 66 and 68 respectively. The ramp support surfaces 66 and 68 extend a selected distance and have a slope which approximates the ergonomic design angle which is adapted to reduce fatigue, stress and discomfort of the thigh, lower leg and foot of a human user in a sitting position. The substantially planar side support members 38 and 40 are operatively coupled to and extend in the same substantially normal direction from the base support 22 and base plate 24 and in a spaced parallel relationship to each other with the substantially planar support surfaces 60 and 62 of the first support ends 44 and 46, respectively, of the side support members 38 and 40 positioned adjacent the base support 22 and with the ramp support surfaces 66 and 68 positioned to extend in the same direction.

A plurality of massage assemblies 70 each of which include an axially extending center support member 74 and a plurality of annular shaped massage elements 72 are mounted axially on and rotatable about the center support members 74. The ends of each center support member 74 in side wall 40 of FIG. 1 are identified by numerals 76 to 86. As is apparent from FIGS. 1 and 2, the center support members are mounted on an arcuate, spaced parallel alignment between the spaced, parallel planar side support members 38 and 40 and above the base support 22. Each of the plurality of massage assemblies 70 are also located above the opposed surface 32 of base plate 24 .

In order to insure that the massage elements 72 do not extend beyond the housing means 20, the radius of the spherical massage elements 72 extend from the center support member 74 to below the ramp support surfaces 66 and 68.

The plurality of message assemblies 70 together form an arcuate shaped, which is generally convex, treating surface. The treating surface is angularly disposed and extends between the substantially parallel side support members 38 and 40.

In the preferred embodiment illustrated in FIGS. 1 and 2, the base plate 24, which is integral with the base support 22, has affixed to the substantially planar surface 30 a resilient covering 90 which has a plurality of substantially parallel protruding members extending therefrom. A user, when utilizing the combined foot massage and support as shown in FIG. 2, has a resilient support for the feet.

Figure 4:
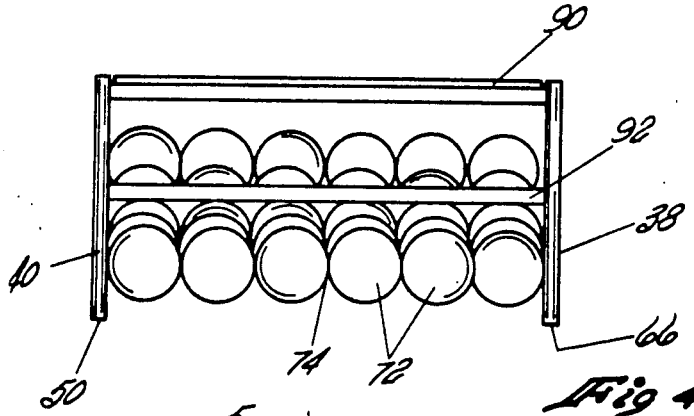
FIG. 4 is an end view of the combined foot massage and support of FIG. 1.
Figure 3:
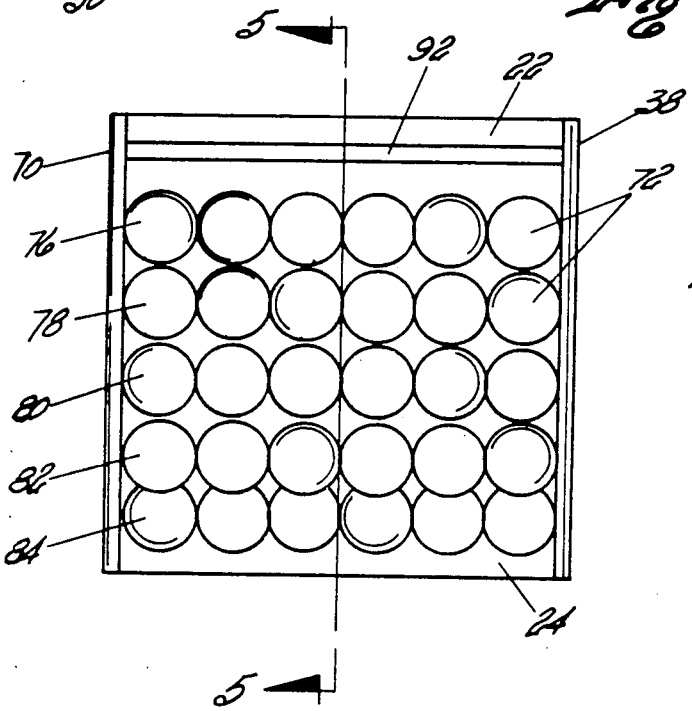
FIG. 3 is a top plan view of the combined foot massage and support of FIG. 1.
Figure 5:
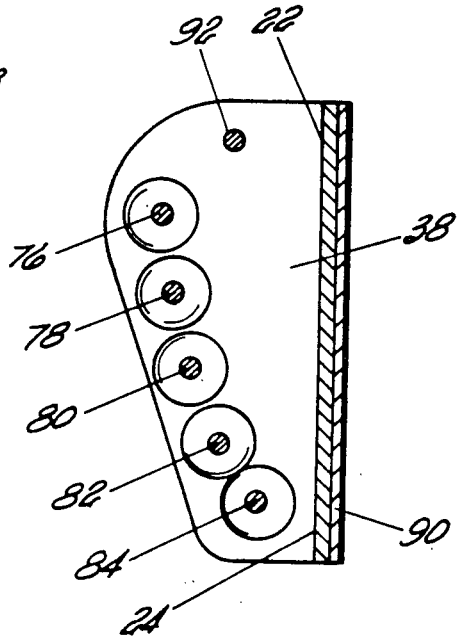
FIG. 5 is a section view taken along section lines 5—5 of FIG. 3.

In FIGS. 3, 4, and 5 the convex treating surface formed by the massage elements 72 of the plurality of massage assemblies 70 is readily apparent. The angle of the convex shaped treating surface permits a user to place the arch of a foot over the convex shaped massage assemblies 70 to massage the foot. A handle 92 is provided to lift and/or reverse the position of the foot massage and support.

As illustrated in FIG. 1, the foot massage and support 20 has a massage portion wherein the base support 22, the substantially planar surface 30 of the base plate 24 and the substantially planar support surfaces 60 and 62 of the side support members 38 and 40, respectively, are positioned on a supporting surface.

In the massage position, the convex shaped, angularly disposed treating surface is adopted to receive the feet of user which may be massaged by movement of the feet relative to the rotatably mounted massage elements 76. A dashed foot 88 illustrates that the preferred size of the massage elements 70 is that two of the elements are sufficient to support the foot 88.

In FIG. 5, the preferred ergonomic design angle is about 10° to about 20°.

Figure 6:
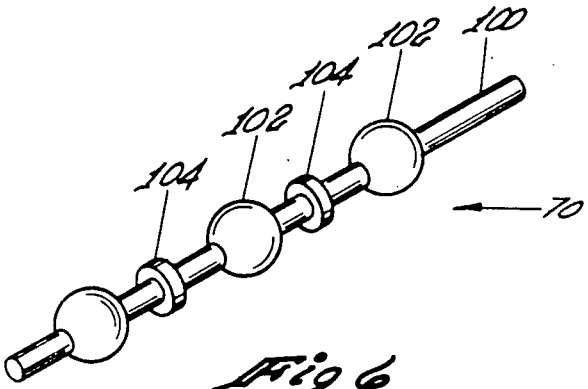
FIG. 6 is an exploded perspective view of a different embodiment of a massage assembly having spherical massage elements and spacers therebetween.

FIG. 6 illustrates an alternate embodiment of a massage assembly 70. The massage assembly 70 includes a center support member 100 having alternate spherical shaped massage elements 102 and spacer elements 104 having a radius which is substantially less than that of the massage elements 102. The spacer elements 104 are axially mounted on the center support member 100 and are interposed between adjacent spherical massage elements 102.

Figure 7:
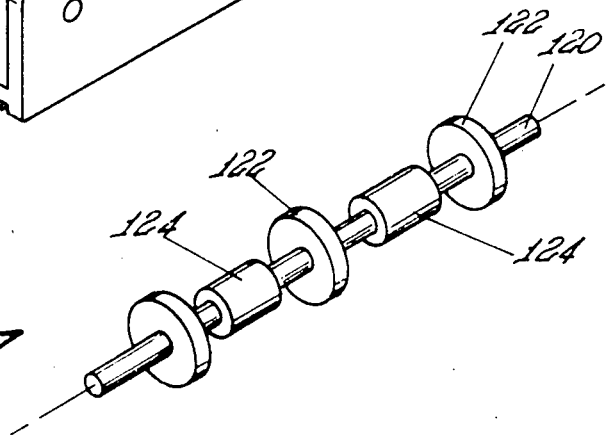
FIG. 7 is an exploded perspective view of a yet another embodiment of a massage assembly having toroidal shaped massage elements and cylindrically shaped spacers therebetween.

FIG. 7 shows another embodiment of a massage assembly having a center support member 120 and massage elements 122 which are toroidal in shape. Cylindrically shaped spacer elements 124 have a hollowed out central area which is adapted to receive and pass the center support member 120. The cylindrically shaped spacer elements 124 are interposed between the adjacent toroidal massage elements.

Figure 8:
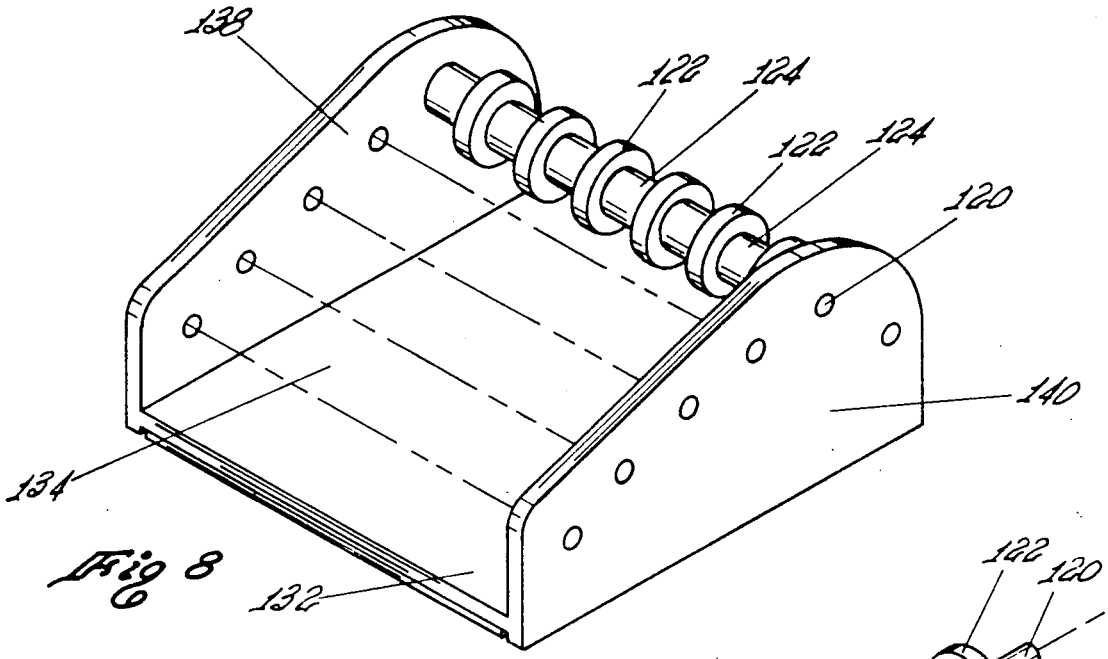
FIG. 8 is a top perspective view of a combined foot massage and support having a plurality of massaging assemblies illustrated in FIG. 7.

FIG. 8 illustrates the integral foot massage and foot support using the massage assembly of FIG. 7. Side supports 138 and 140 support the center support members of which center support member 120 is typical. A base support 122 is integral with the base plate 124. The axial length of the cylindrical spacers is a function of the desired spacing between the toroidal massage members 122.

Figure 9:
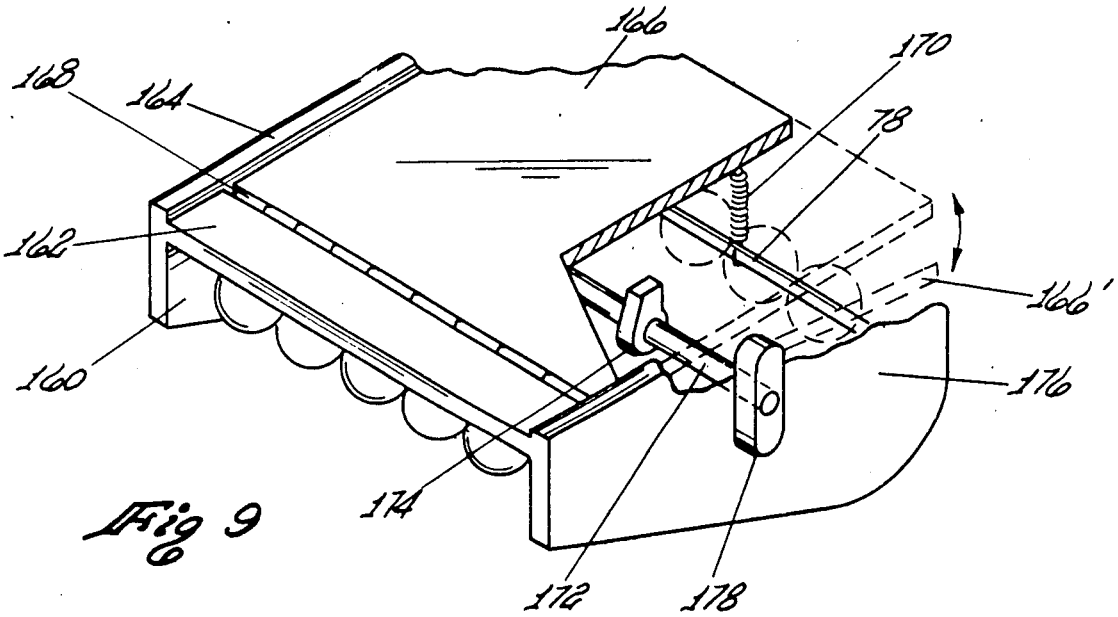
FIG. 9 is a exploded partial perspective view of a variation of the embodiment of FIG. 1 wherein the base plate is pivotable relative to the base support and housing.

FIG. 9 shows another embodiment of a combined foot massage and support wherein a base plate 166 is pivotly mounted for movement relative to the base support 162. The base support 162, the planar support surface 164 of side support 160 form the housing means. The base plate 166 is moveable into a position shown by 166' to vary the angle thereof. As illustrated in FIG. 9, a hinge 168 is provided to enable the base plate 166 to rotate relative to the fixed base support 162.

An elongated rod 172 is rotatably mounted for rotation between the side support members 164 and 176 by means of handle 178. The elongated rod 172 is positioned below the massage elements (not shown) and in substantially spaced parallel alignment with the center support member 78 being exemplary.

A cam member 174 having a shaped surface is fixedly mounted onto and moveable with rotation of the elongated rod 172. The shaped surface of the cam member 174 is positioned in moveable engagement with the opposed substantially parallel surface so as to vary the angle of the base plate 166 relative to the base support 162.

A resilient means 170, which may be a helical spring, is operatively coupled between one of the center support members, such as member 78, and the opposed substantially parallel surface of the base plate 166 to apply a clamping force therebetween. The clamping force of resilient means 170 maintains contact between the base plate 166 and the cam member 174 whereby rotation of the elongated rod 172 in a selected direction of rotation will rotate the cam members 174 varying the position of the shaped surface being urged against the base plate 166 to change the angle thereof relative to the base plate.

Figure 10:
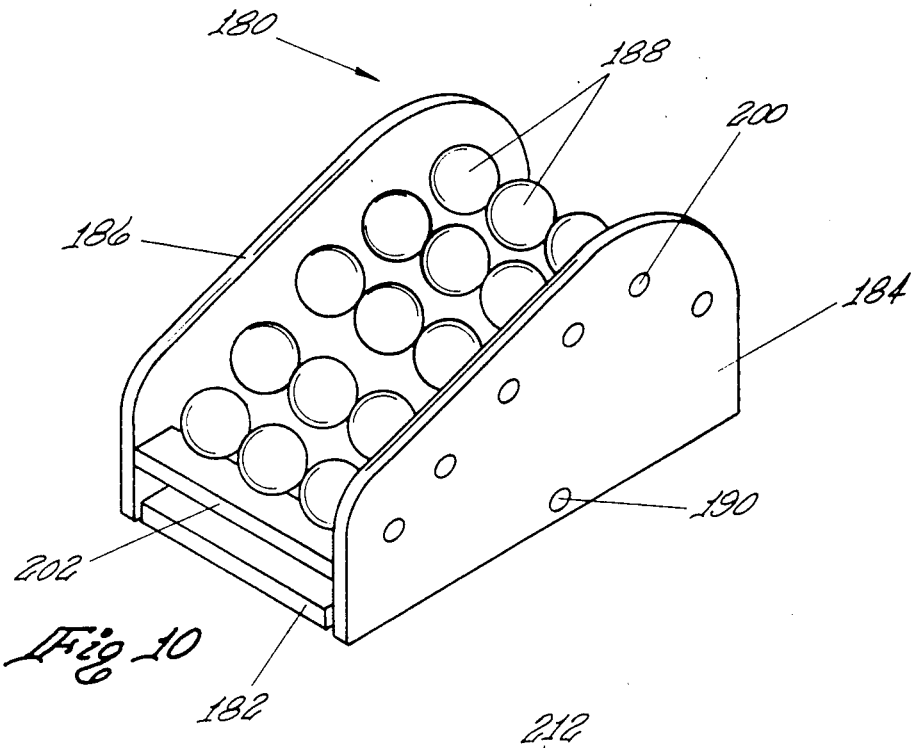
FIG. 10 is a perspective view of a combined foot massage and support device having a width to accommodate one foot of a user.

FIG. 10 illustrates a combined foot massage and support apparatus 180 having a base 182 having side walls 184 and 186 affixed thereto with a dimension or width to support three message elements 188 mounted on central supports 200. This width is intended to accommodate one foot of a user. In this embodiment, the base palte 182 is mounted at pivot point 190 to be moveable or to be rocked in a pitch mode, about the axis of the pivot point 190. A toe bar 202 is provided for exercising the toes of a user.

Figure 11:
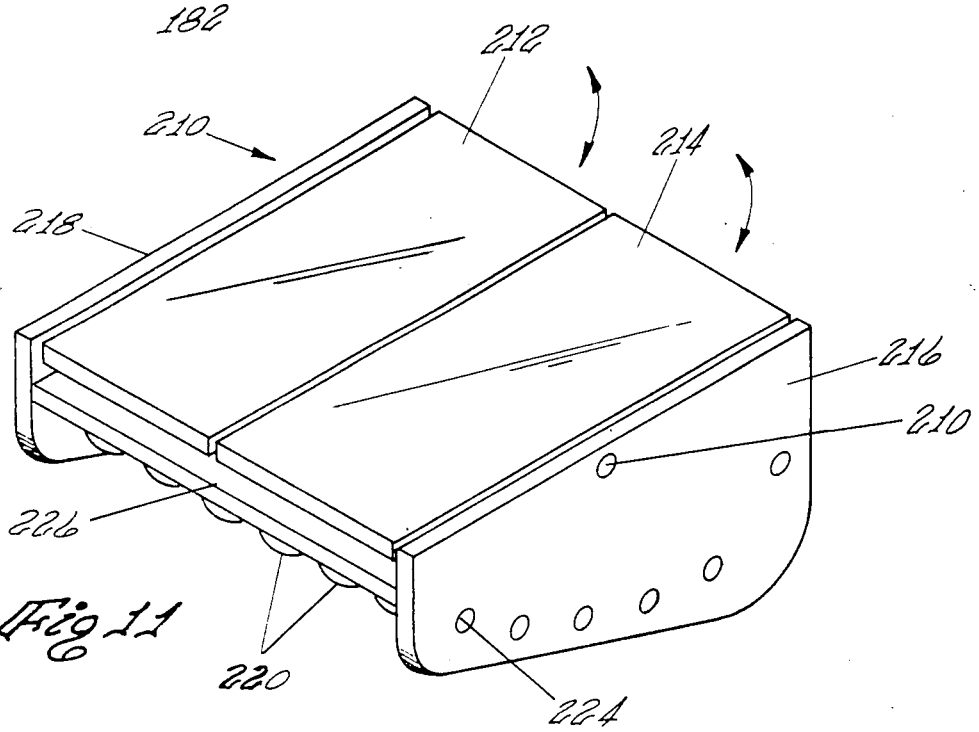
FIG. 11 is a perspective view of a combined foot massage and support device having a pivotally mounted base plate which is divided into two parallel sections each of which can be independently pivoted by the two feet of a user.

FIG. 11 illustrates another embodiment of a support shown generally by arrow 210 wherein the base plate is formed of two half sections 212 and 214 which are adapted to be pivotally mounted to side walls 216 and 218 at axially aligned pivot points on the axis of the pivot point 210. Sufficient massage elements 220 mounted on central supports 224 are provided in a width to accommodate two feet of a user. A user may place both feet on the support in the position shown in FIG. 11, on each on one of the half sections 212 and/or 214. The feet can then be used to independently rock or rotate the base half sections 212 and 214 about the pivot point 210 as shown by the arrows. A toe bar 226 is also provided to exercise the user's toes.

Figure 12:
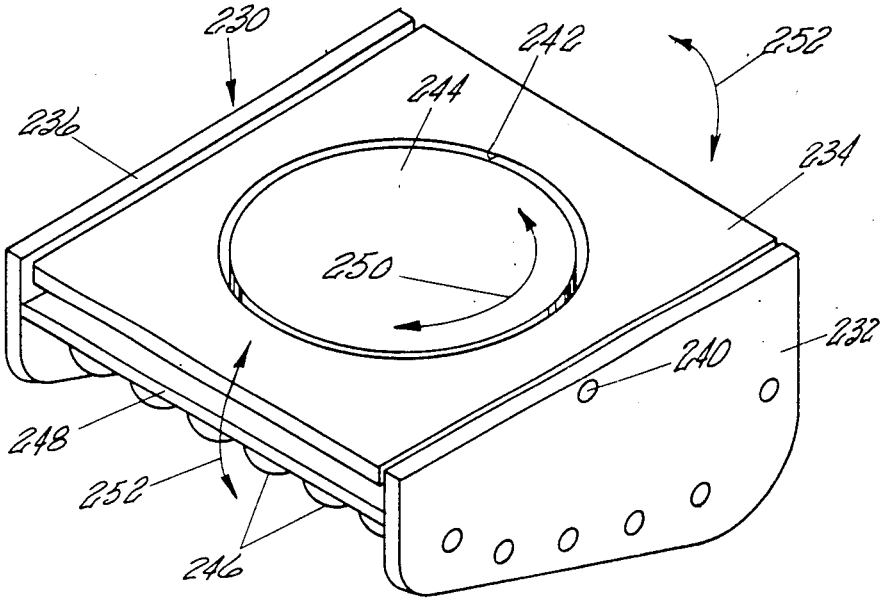
FIG. 12 is a perspective view of a yet another embodiment of a combined foot massage and support similar to that of FIG. 1 with a rotatable disc mounted in the base plate.

FIG. 12 illustrates a combined foot massage and support apparatus 230 comprising a base support including a base plate 234 having a substantially planar surface and a second opposite surface. The base plate 234 has a circular shaped opening 242 located centrally therein. A pair of substantially planar side support members 232 and 236 each of which terminate in a first support end and a second support end. The first support end of each of the side support members 232 and 236 including means defining a substantially planar support surface and the second support end of each of the side support members 232 and 236 being located opposite the first support end and including means defining a ramp support surface which has a slope which approximates the ergonomic design angle which is adapted to reduce fatigue, stress and discomfort of the thigh, lower leg and foot of a human user in a sitting position. In the embodiment of FIG. 12, a means including a rotatable disc 244 is positioned in the circular opening 242 in the base plate 234. The rotatable disc 244 is adapted to be engaged and rotated by at least one foot of a user. The rotation is illustrated by the arrow 250 imposed on the rotatable disc 244 in FIG. 12.

In addition, the base plate 234 is pivotally mounted at pivot point 230 and is adapted to be moved in a rocking or pitch direction as shown by the arrows 252. The message elements 246 are supported by central rod members extending between the side walls in the manner described hereinbefore. The support 230 includes a toe exercise bar 248.

Figure 13:
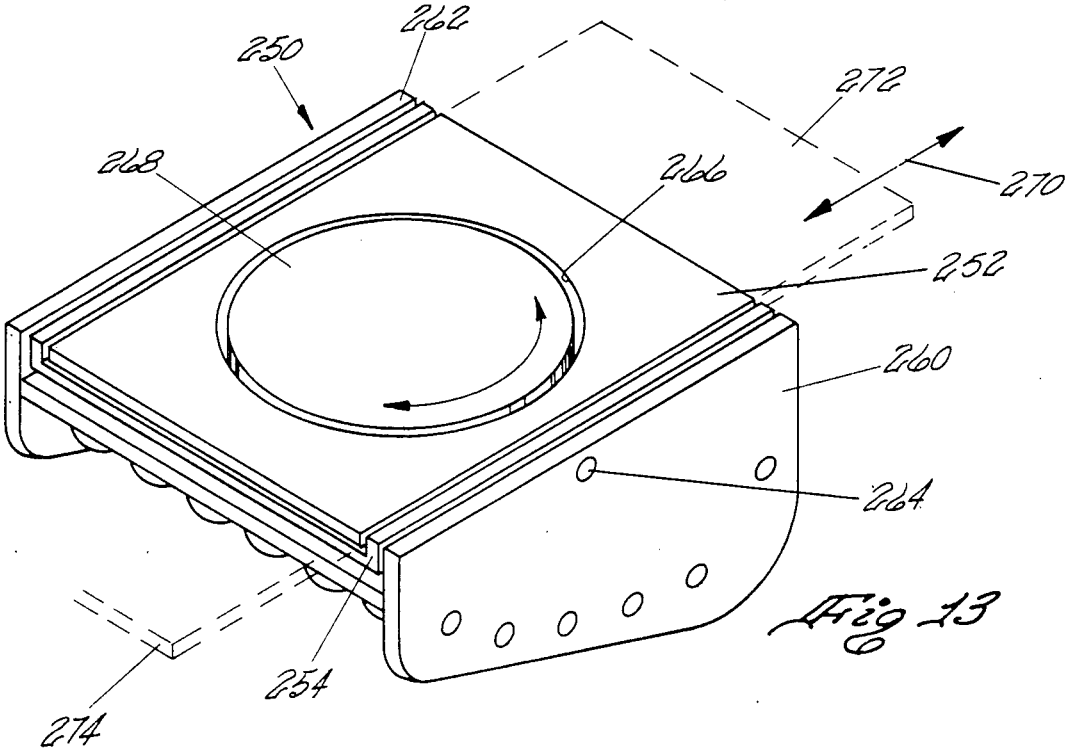
FIG. 13 is a perspective view of a yet another embodiment of a combined foot massage and support similar to that of FIG. 10 with the base plate being moveable in a plane.
Figure 14:
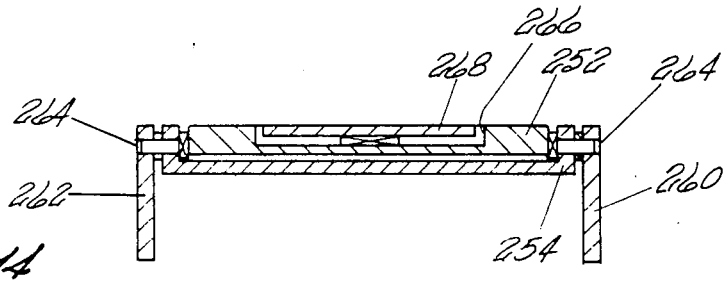
FIG. 14 is a sectional end view of the embodiment illustrated in FIG. 13 illustrating the slidable base plate assembly.

The combined foot massage and support 250 illustrated in FIGS. 13 and 14 include a base plate 252 which is slideable into the positions illustrated by phantom base plate positions 272 and 276 and in the directions shown by arrow 270. In the embodiment of FIG. 13, the base plate 252 has a central opening 266 which is adapted to receive a rotatable disc 268. An intermediate support member 254 is pivotally mounted to side walls 260 and 262 and is slideably attached to the base plate 252 to afford the sliding movement therebetween and relative to the side walls 260. The relationship between the side walls 260 and 262, the pivot supports 264 and the intermediate member 254 is illustrated in FIG. 14.

Figure 16:
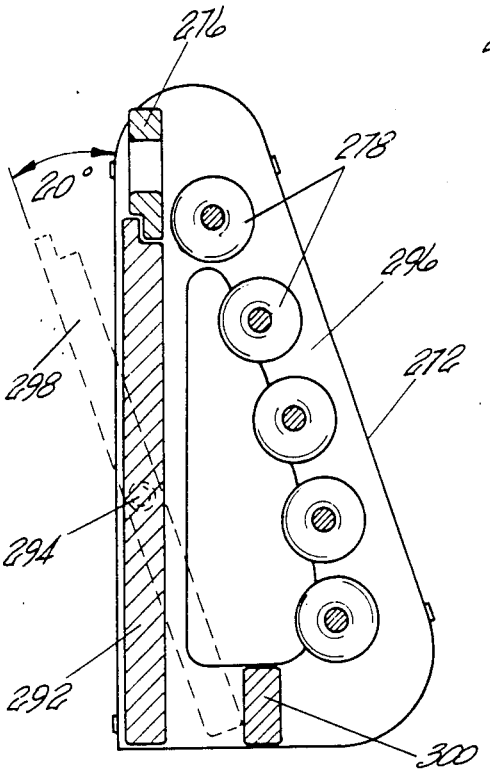
FIG. 16 is an end view of the combined foot massage and support of FIG. 15 showing the pivotal positions of the base plate.
Figure 15:
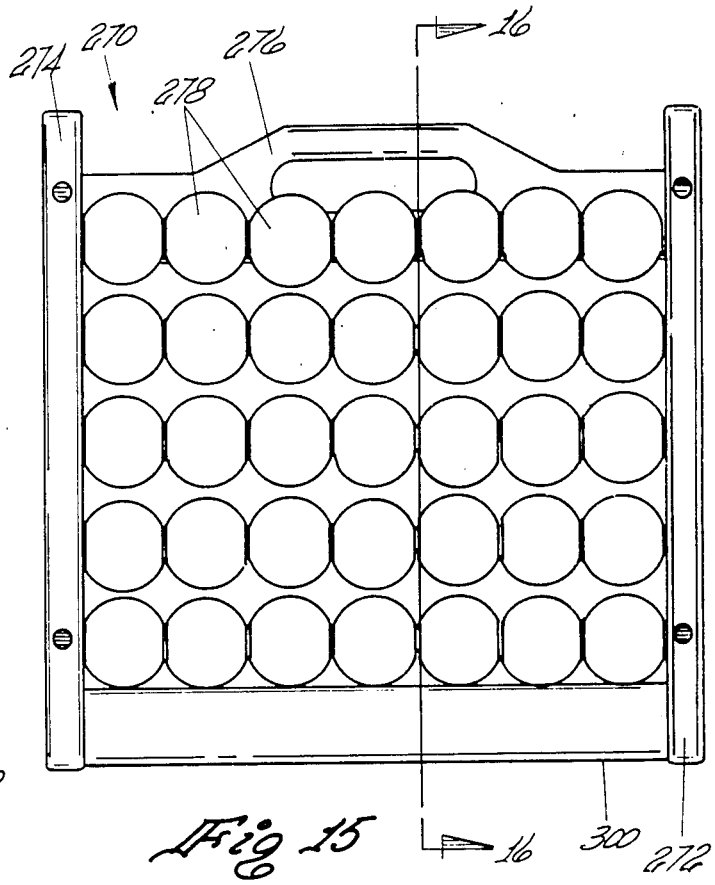
FIG. 15 is a top plan view of the combined foot massage and support having a carrying handle and a pivotally mounted base plate.

FIGS. 15 and 16 illustrate a combined foot massage and support 270 having side walls 272 and 274 for supporting the massage elements 278 and a handle 276 for carrying the support 270. As illustrated in the side view of FIG. 16, the support 270 has the sidewalls 274 with a central opening which defines a frame 296 for the central support members for supporting the message members 278. In addition, a base plate 292, which is pivotally attached to the side walls 272 and 274 at pivot point 294, is rotatable approximately 20° which is controlled by a stop 300. In order to use the pivotal base plate, the support is placed on a horizontal surface with the massage members under the base plate 292 which results in the degree of pivot to be from a $-2°$ to a $+18°$ relative to a horizontal surface.

Figure 17:
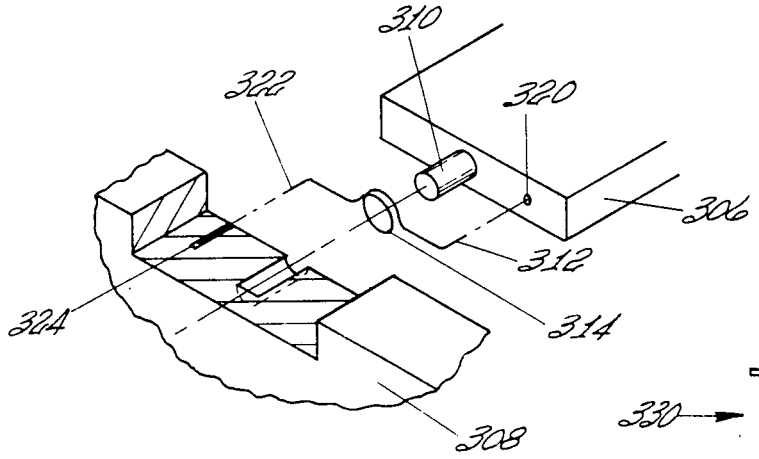
FIG. 17 is an exploded perspective view of a the preferred embodiment of a combined foot massage and support having a pivotally mounted base plate an a torsion spring for applying a restoring force to the base plate to keep it in position when the support is being carried by the user.

FIG. 17 illustrates an embodiment wherein a support includes torsion spring members 314 for insuring that a pivotal base plate 306 is held in position relative to the side walls with side wall 304 being typical. The base plate is pivotally mounted by means of a dowel 310 which is affixed to the base plate 306 but which is rotatable mounted in the side wall 308. the torsion spring has a central loop and two arms which terminate in "L" shaped ends 318 and 322. The end 318 is inserted into an aperture formed in the base plate 306 while the end 314 is inserted into an aperture 324 formed in side wall 308. The torsion in spring 314 is such that the base plate 306 is held substantially planar to the side wall bottom members.

Figure 18:
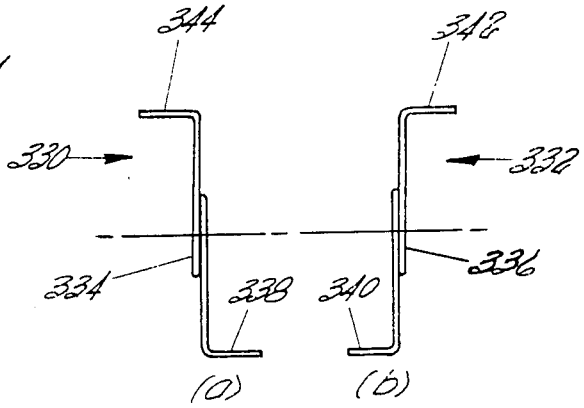
FIGS. 18(*a*) and 18(*b*) are top views of the torsions springs used on each side of the base plate.

FIGS. 18(*a*) and 18(*b*) illustrate that a match set of torsion springs 330 and 332 are required for each support. Each spring includes a central loop 334 and 336, respectively. Torsion spring 330 has two ends, end 344 which is inserted into an aperture in one side wall and end 338 which is inserted into an aperture in the base plate. In a similar manner but opposite in design to be complementary, the torsion spring 332 has end 342 which is adapted to be inserted into an aperture in the opposite side wall and an end 340 which is adapted to be inserted into an aperture in the same base plate.

The present invention has wide utility in both industrial and health applications. The present day trends in the computer and production fields generally require a human being to spend substantial time in a sitting position. Accordingly, the fatigue, stress and discomfort of a human being is greatly reduced by elevating the feet, legs and thighs. As a result thereof, the duration span, comfort and health of a user is substantially improved by application of the ergonomic principles to the combined foot massage and foot rest.

In addition, the foot massage treating surface has theraputic value, that is, by massage of the feet of a user at the preferred ergonomic angle, the circulation in the feet is improved while reducing stress and fatigue in the legs and thighs of a user.

The teachings of the present invention have substantial utilities for use by computer terminal operators and word processing operators.

What is claimed is:

1. A combined foot massage and support comprising a base support including a base plate having a substantially planar surface for defining a support when the base plate is placed on a support surface and defining a foot receiving surface when the base plate is positioned in a spaced opposed position to the support surface, and a second opposite surface, said base plate being pivotally mounted for movement relative to the base support;

a pair of substantially planar side support members each of which terminates in a first support end and a second support end, said first support end of each of said side support members including means defining a substantially planar support surface and said second support end of each of said side support members being located opposite said first support end and including means defining a ramp support surface having a slope which approximates an ergonomic design angle which is at least 10° to about 20°, said ergonomic design angle being selected so as to reduce fatigue, stress and discomfort of the thigh, lower leg and foot of a human user in a sitting position, said substantially planar side support members being operatively coupled to and extending in the same substantially normal direction from said base support and base plate and in a spaced parallel relationship to each other with the substantially planar support surface of each of the first support end of each of said side support members positioned adjacent said base support and with the ramp support surface of the second support end of each of said side support members positioned with the ramp support surface extending in the same direction; and a plurality of massage assemblies each of which includes an axially extending center support member and a plurality of annular shaped massage elements mounted axially on and rotatable about said center support members, said center support members being mounted in an arcuate, spaced parallel alignment between said spaced parallel planar side support members and along said ramp slope positioning said plurality of massage assemblies at said ergonomic design angle above said base support and above said opposite side of the base plate, said plurality of massage elements being mounted on said center support members and having a radius which extends therefrom to below said ramp support surfaces to form a convex shaped, angularly disposed treating surface which extends substantially between said substantially parallel side support members with said treating surface being positioned at said ergonomic design angle;

said foot massage and support being adapted to have a massage position wherein the base support, the substantially planar surface of the base plate and the substantially planar surface of the side support members are positioned on a supporting surface placing the convex shaped, angularly disposed treating surface at said ergonomic design angle in a massage position which is adapted to receive the feet of a user which may be massaged by movement of the feet relative to the rotatably mounted massage elements and a support position wherein the ramp support surfaces of the second support end of each side support members are positioned on a supporting surface placing the base support including the substantially planar surface of the base plate defining a foot receiving surface at said ergonomic design angle to receive and support the feet of a user.

2. The combined foot massage and support of claim 1 wherein said base plate is a separate member having a pair of opposed parallel planar surfaces and further comprising a hinge operatively coupled to said base plate and base support to enable said base plate to be rotatable relative to the base support to vary the angle thereof when the foot massage and support is in the support position.

3. An integral foot massage and support comprising a base plate having a substantially planar surface for defining a support when the base plate is placed on a support surface and defining a foot receiving surface when the base plate is positioned in a spaced opposed position to the support surface;

housing means operatively coupled to said base plate and including means for defining side members; and a plurality of massage assemblies each of which includes an axially extending center support member and a plurality of annular shaped massage elements mounted axially on and rotatable about said center support members, said center support members being mounted between said side members at an angle which approximates the ergonomic design angle which is at least 10° to about 20°, said ergonomic design angle being selected so as to reduce fatigue, stress and discomfort of the thigh, lower leg and foot of a human user in a sitting position, said base plate being pivotable relative to said housing to change the angle thereof independent of said ergonomic design angle enabling the feet of a human user to exercised.

4. The apparatus of claim 3 wherein said side members include means defining an outer surface and wherein said center support members are mounted in a convex, spaced parallel alignment between said side members to form below the outer support surfaces of said side members an arcuate-shaped, angularly disposed treating surface.

5. The apparatus of claim 3 wherein massage elements are spherical in shape and have a radius selected to enable two adjacent massage elements to receive and support the foot of a user.

6. The apparatus of claim 4 wherein said housing means includes a base support pivotally attached to the housing enabling said base plate to be movable relative to both said housing and base support; and wherein said apparatus is adapted to have a massage position wherein the base support and base plate are positioned on a supporting surface placing the arcuate-shaped, angularly disposed treating surface in a massage position to receive the feet of a user which may be massaged by relative movement of the feet relative to the rotatably mounted massage elements, and a support position wherein each side member is positioned on a supporting surface placing the base support including the substantially planar surface of the base plate at an angle to receive and support the feet of a user and enabling the feet of a user to be exercised by rotating the base plate relative to the housing and base support.

* * * * *